United States Patent [19]

Merlin

[11] Patent Number: 4,500,047

[45] Date of Patent: Feb. 19, 1985

[54] SPOOL ADAPTOR

[76] Inventor: Philip Merlin, 3 Gladwyne Ct., Spring Valley, N.Y. 10977

[21] Appl. No.: 513,683

[22] Filed: Jul. 14, 1983

[51] Int. Cl.[3] ..... B65H 75/18

[52] U.S. Cl. ..... 242/71.9; 242/118.5

[58] Field of Search ..... 242/118.4–118.8, 242/129.5, 129.7, 129.71, 68, 68.3, 68.5, 68.6, 71.8, 71.9, 116

[56] References Cited

U.S. PATENT DOCUMENTS

| | | | |
|---|---|---|---|
| Re. 31,015 | 8/1982 | Moore | 242/71.9 |
| 2,518,533 | 8/1950 | Edwards | 242/71.8 |
| 3,041,005 | 6/1962 | Wallace | 242/116 |
| 3,132,821 | 5/1964 | Herden | 242/68 |
| 3,207,454 | 9/1965 | Bendar | 242/68.3 |
| 3,391,876 | 7/1968 | Dalglish | 242/56.9 |
| 4,117,988 | 10/1978 | Moore | 242/71.9 |

*Primary Examiner*—Leonard D. Christian

*Attorney, Agent, or Firm*—Curtis, Morris & Safford

[57] ABSTRACT

An adaptor for use with flangeless spools of coiled tie material having cylindrical central cores about which the tie material is wound, includes a cylindrical center section, a pair of circular flange sections, each of which is mounted to an end of the center section and at least one of which is removable therefrom, and a spool engaging device which prevents a spool mounted on the center section from rotating independently of the adaptor. The spool engaging device includes a pair of spacer pads and a blade interposed between the pads. The spacer pads and the blade are housed in a slot formed in a portion of the center section. The blade angularly protrudes from the circumferential surface of the center section a distance which is sufficient to at least partially cut into the thickness of the core of the spool thereby preventing rotational movement of the spool relative to the adaptor.

13 Claims, 5 Drawing Figures

SPOOL ADAPTOR

BACKGROUND OF THE INVENTION

Field of the Invention

The present invention relates to a new and useful device for holding coils of tie material and more particularly relates to an improved spool adaptor for holding coils of elongated tie material.

In recent years tie ribbon, much of which is manufactured from wire embedded in plastic or paper, has been used on an ever increasing scale for tying packages such as bread bags. In an automated system the tie material or ribbon comes wound on a spool or reel which rotatably mounts on a spindle of a tie wrapping machine. Desired lengths of the ribbon are automatically unwound and severed.

The spools used in the past have been unitary in design with two circular flanges mounted integrally to the ends of a cylindrical, central wrapping core. These spools, in addition to being expensive, produce a handling problem and the accumulation of large numbers of spools presents a disposal problem.

Advances in the art have made it possible to use a flangeless spool comprising basically a central core about which the wire or tie ribbon is wound. The coil is made stable and secure by twisting the ribbon periodically during the winding operation.

However, direct use of the flangeless spool poses many problems. In most applications, a sufficient frictional drag must be provided on the spool to prevent the tie material from unraveling. The central core alone might not provide enough exposed surface area to apply a braking force. Furthermore, even if the ribbon is twist wound on the core, during handling, loading on the tie wrapping machine or during a wrapping operation, it is possible for the ribbon to slip off the sides of the flangeless spool and wrap around the spindle on which the spool is mounted. This causes down time in the tie wrapping operation while the ribbon is being untangled.

To solve the above-mentioned problems, it has been suggested in U.S. Pat. No. Re. 31,015, issued to Doyle A. Moore on Aug. 24, 1982, which is a reissue of U.S. Pat. No. 4,117,988, issued on Oct. 3, 1978, to use a spool adaptor having a tubular center section and a pair of circular flange sections mounted to each end of the center section. One of the flange sections is removable so that the adaptor can accept spools of coiled tie material. The center section of the adaptor is segmented to form expandable legs. A collet expander is threaded onto a shaft inserted centrally through the center section and tightened to cause the legs of the segmented center section to move radially outwardly from the center section and engage the central core of the spool. In this manner the spool rotates with the adaptor without slipping.

The adaptor disclosed in the above patents has many inherent disadvantages. The device is mechanically complex and employs a number of parts. For this reason it is expensive to manufacture. Only a trained worker would be skilled enough to assemble the device or to break it down into its component parts to remove or replace a worn element.

OBJECTS AND SUMMARY OF THE INVENTION

It is an object of the present invention to provide an improved adaptor which accepts spools of coiled tie material, wire or the like and which allows the spool to be easily and quickly removed and replaced, resulting in little down time to the tie wrapping operation.

It is another object of this invention to describe a spool adaptor which includes side flange sections to keep the tie ribbon from slipping off the ends of the spool and which engages the core of the spool in a simple manner so that the adaptor and spool will rotate in a unitary fashion.

It is yet another object of the present invention to provide a spool adaptor which is mechanically simple and requires few parts.

It is a further object of this invention to provide a spool adaptor which can be inexpensively manufactured and easily assembled or disassembled.

It is a still further object of the present invention to provide an improved spool adaptor which, because of its mechanical simplicity, is more reliable than heretofore known adaptors.

The present invention provides an adaptor for use with spools of coiled elongated material, the spools being essentially no more than a central cylindrical core around which the material is repeatedly wrapped. The adaptor basically comprises a cylindrically shaped center section, two circular flange sections mounted to the ends of the center section and means for engaging a spool mounted on the adaptor to prevent rotational movement of the spool relative to the adaptor. At least one of the flange sections is removable to expose a free end of the center section for mounting the spool on the adaptor. The center section has a bore formed axially therethrough to receive a spindle of a tie wrapping machine. The adaptor, which is mounted on the spindle, and the spool, which is secured to the adaptor by the flange sections and the spool engaging means, can turn on the tie wrapping machine as a single unit.

The above and other objects, features and advantages of this invention, will be apparent in the following detailed description of illustrative embodiments thereof, which is to be read in connection with the accompanying drawings.

DETAILED DESCRIPTION OF THE PREFERRED EMBODIMENT

Figure 1:
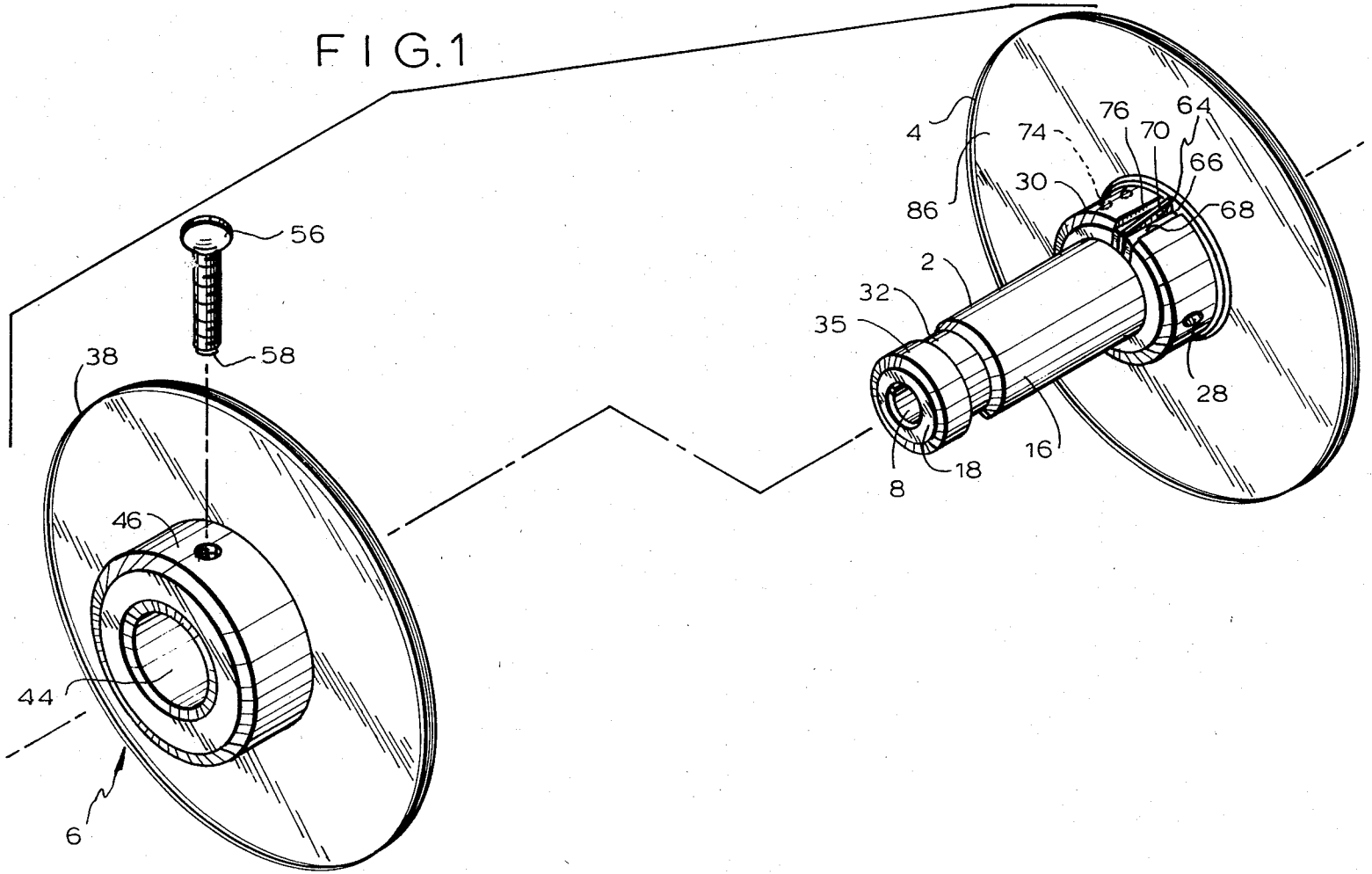
FIG. 1 is a partially exploded isometric view of a preferred embodiment of the spool adaptor according to the present invention.

Referring now to the drawings in detail and to FIGS. 1–5 thereof, it will be seen that a spool adaptor constructed in accordance with the present invention includes a cylindrically shaped center section 2 and first and second circular flange sections 4,6 mounted on opposite ends of the center section 2. At least one of the flange sections 4,6 is removable which, in most applications, is all that need be removed to mount the spool on the adaptor. However, it is envisioned that the adaptor be designed with two removable flange sections.

The center section 2 has a bore 8 formed centrally therein which runs in the axial direction the entire length of the section 2. The bore 8 is of sufficient diameter to receive a spindle 10 of a tie wrapping machine. The adaptor can be fixedly or rotatably mounted on the spindle 10, depending upon the type of machine used.

The center section 2 includes a boss 12 situated at an outermost end thereof, an inner hub 14 adjacent the boss 12 and a main body portion 16 which extends from the inner hub 14 to the other end 18 of the center section. The boss 12 has formed in its outer surface 20 a stepped portion 22 which, as will become more apparent later in the description, provides a seat for one of the flange sections 4,6.

All three components of the center section, i.e., the boss 12, the inner hub 14 and the main body portion 16, are cylindrical in shape. The boss 12 has the largest diameter of the three center section components with the stepped portion 22 being slightly smaller in diameter than the boss 12. The diameter and axial length of the inner 14 hub are chosen to allow the hub to be closely received by the core 24 of the spool and to provide sufficient support for the spool when it is mounted on the adaptor. A snug fit between the hub 14 and the core 24 will prevent the spool from wobbling on the adaptor.

Although it is possible to form the remainder of the center section, i.e., the main body portion 16, with the same diameter as that of the inner hub 14, it is preferable that the main body portion 16 have a diameter which is less than that of the hub in order to keep the weight of the adaptor as light as possible.

The center section 2 is further provided with a pair of set screws 26 having allen key heads. The screws are threaded into tapped holes 28 formed radially in the inner hub 14 which extend from the circumferential surface 30 of the hub 14 to the bore 8 formed in the section. These set screws 26, when tightened, engage the spindle 10 and prevent the spool adaptor from rotating thereon.

So that the adaptor can be used with tie wrapping devices which have nonrotating spindles but which require the spool to rotate, set screws 26 are selected which have overall lengths smaller than that of their receiving holes 28. The set screws 26 can be screwed into their receiving holes 28 far enough to be flush with or below the surface 30 of the inner hub 14 without contacting the spindle 10. In this way, they do not interfere with the core 24 of the spool mounted on the adaptor and allow the adaptor to rotate freely on the spindle 10.

For reasons which will become apparent later in the description, the main body portion 16 has a groove 32 formed circumferentially in the surface 35 thereof near the end of the center section 2 which is opposite that at which the boss 12 and inner hub 14 are situated.

The center section 2 is preferably formed from a single piece of metal, such as aluminum, by milling on a lathe, although the section could quite as easily be constructed as an assembly of individually formed components.

As previously mentioned, the first and second circular flange sections 4,6 are mounted to the ends of the center section 2. The first flange section 4 comprises basically a relatively thin, circular plate 34 having an opening 36 formed centrally therein. The opening 36 conforms to the diameter of the stepped portion 22 of the boss 12 so that the first flange section 4 can be press-fitted onto the stepped portion. In this manner, the first flange section can be securely mounted to the center section 2.

The second flange section 6 comprises a flat, circular plate 38 with a centrally formed opening 40, similar to that described for the first flange section 4, and a cylindrical mounting hub 42. The mounting hub 42 has a central bore 44 formed axially therein which is dimensioned to receive the main body portion 16 of the center section 2.

Figure 2:
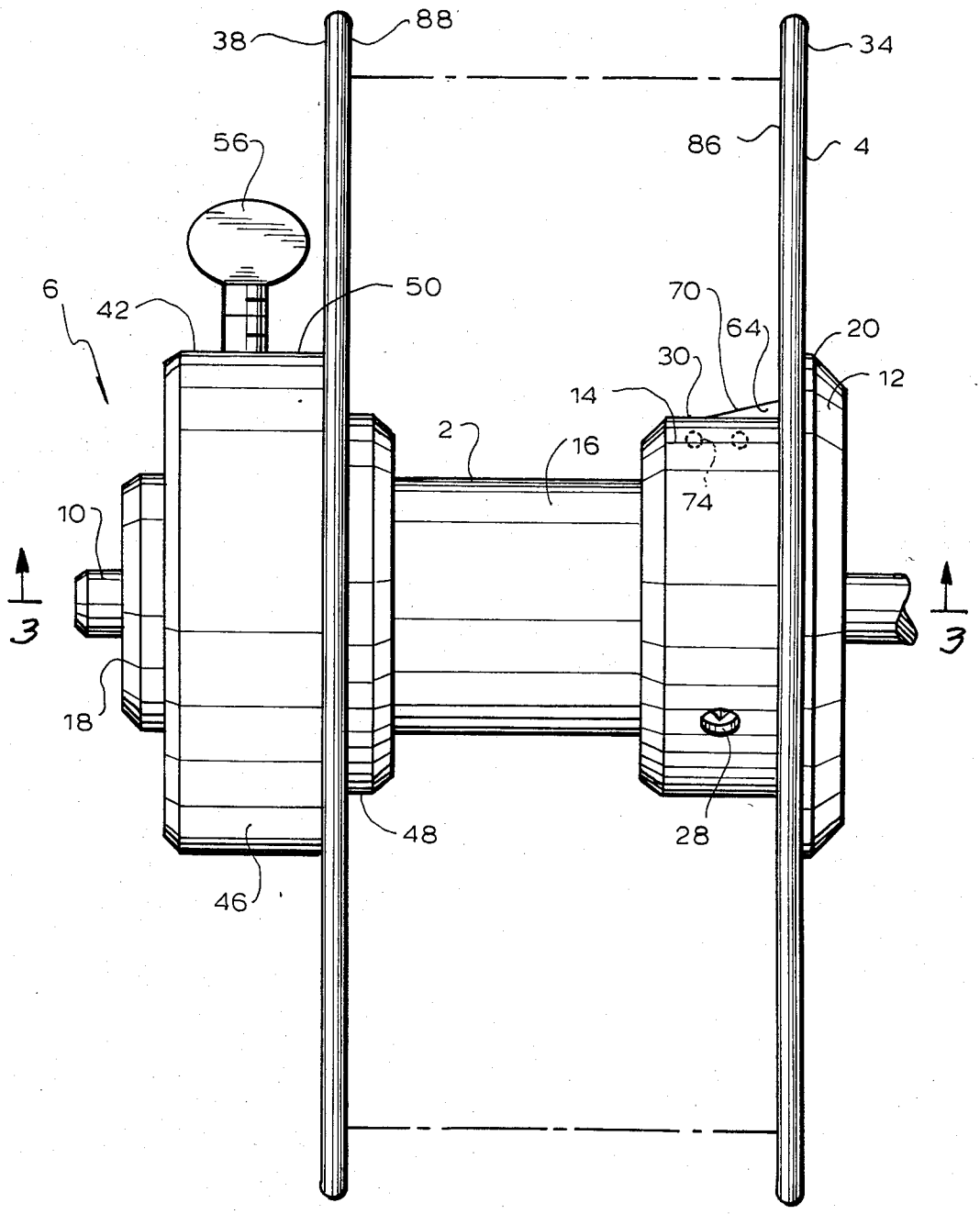
FIG. 2 is a front view of the embodiment shown in FIG. 1 after assembly.
Figure 3:
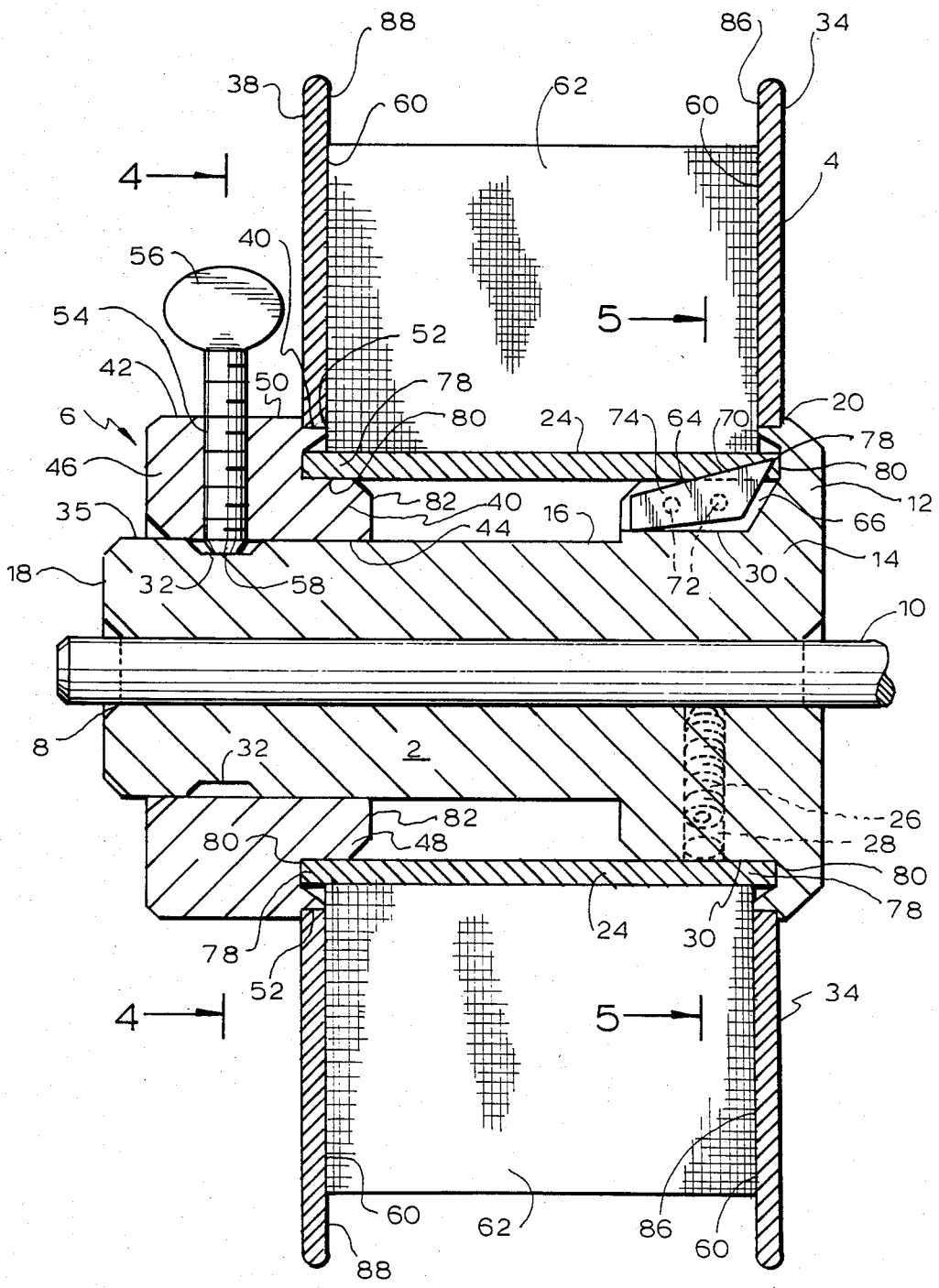
FIG. 3 is a sectional view taken along line 3—3 of the assembly shown in FIG. 2 which includes, in cross section, a spool of coiled tie material.
Figure 4:
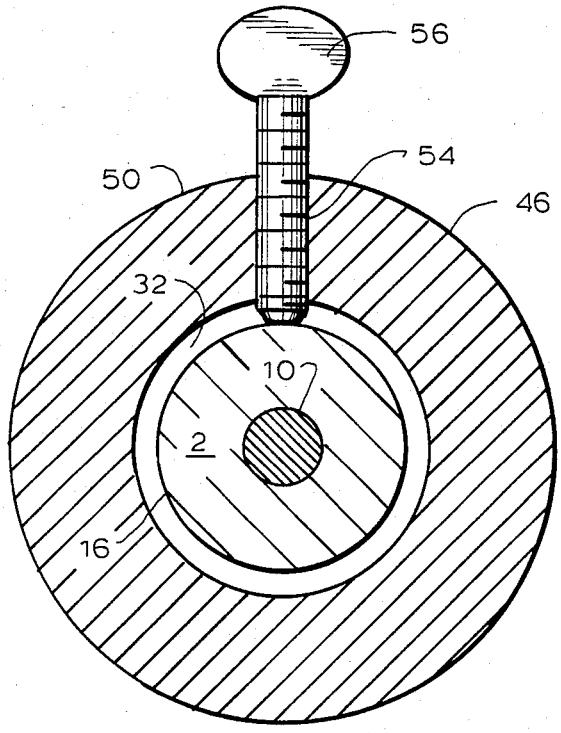
FIGS. 4 and 5 are sectional views of the spool adaptor according to the present invention taken along lines 4—4 and 5—5 respectively of FIG. 3.
Figure 5:
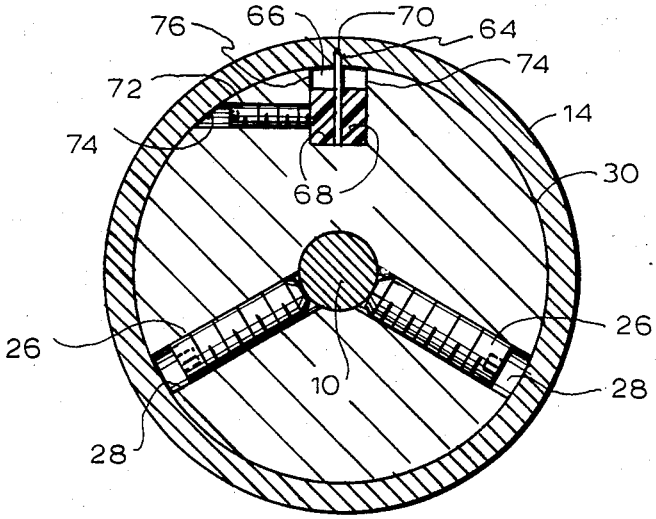

The mounting hub 42 includes an outer collar 46 and an inner hub portion 48 adjacent the outer collar 46. Formed in the circumferential surface 50 of the collar 46 near the inner hub portion 48 is a stepped portion 52 having a diameter which is less than that of the collar 46. This stepped portion 52 provides a seat for the circular plate 38 in much the same way as does the stepped portion 22 formed on the boss 12 of the center section 2. The diameters of the inner hub portion 48 of the second flange section 6 and the inner hub 14 of the center section 2 are essentially equal although the axial lengths of the two need not be the same, as shown in FIG. 2. Together, both inner hubs 14,48 support the spool and prevent radial movement of the spool on the adaptor. The mounting hub 42 and plate 38 are assembled by press-fitting the plate onto the stepped portion 52 of the outer collar 46. The plate 38 thus forms an integral part of the mounting hub 42.

A bore 54 is formed radially through the outer collar 46 and tapped to receive a thumbscrew 56. When assembling the adaptor, the second flange section 6 is positioned on the center section 2 so that the bore 54 provided for the thumbscrew 56 is aligned with the groove 32 formed in the main body portion 16. The thumbscrew 56 is tightened until it contacts the main body portion 16. In this way, even if the thumbscrew should loosen during handling or a wrapping operation, the foot 58 of the thumbscrew 56 remains within the confines of the groove, preventing the second flange section 6 from slipping off the center section 2. The use of the groove 32 advantageously prevents the foot 58 of the thumbscrew from bearing on the main body portion periphery and scoring it. If the main portion was scuffed insertion of the coil could be hindered.

The width of the groove 32 is made slightly larger than the diameter of the thumbscrew 56 to afford the second flange section 6 some adjustment in its position on the center section 2. This adjustment allows one to eliminate any space between the side walls 60 formed by the coiled tie material 62 and the circular plates 34,38 of the flange sections and ensures that the spool is snugly fitted between the plates of the adaptor.

The spool adaptor according to the present invention further includes means for engaging the spool to prevent rotational movement of the spool relative to the adaptor. Because it has almost become a standard in the industry to use spools having cardboard cores, the spool engaging means is very simply a blade 64 which projects from the center section 2 and which pierces the cardboard core 24 of the spool.

Preferably, an axially extending slot 66 is formed in the circumferential surface 30 of the inner hub 14 of the center section. Within this slot 66 is fitted a pair of spacer pads 68. Interposed between the pads 68 is a blade 64 having at least one sharpened edge 70. The blade 64 is positioned in relation to the slot 66 so that at a least a portion of its sharpened edge 70 protrudes above the circumferential surface 30 of the hub 14 and preferably at a slight angle thereto.

The blade 64 is adjustably held in place by a pair of set screws 72 having allen key heads. The screws 72 are received by tapped bores 74 formed in the hub 14 which angularly extend from the surface of the hub to one of the side walls 76 of the hub 14 which define the slot 66. When tightened, the set screws 72 put pressure on the pads 68 which hold the blade securely in position.

When mounting the spool on the adaptor, the spool is placed over the center section 2 and, with slight hand pressure, is forced onto the inner hub 14. The blade 64, which protrudes from the surface of the hub, at least partially cuts into the thickness of the core 24 and firmly holds the spool in place on the adaptor. The angle and height of the blade 64 are adjustable to conform to cores 24 of varying thicknesses.

Although only one blade is shown in the drawings and described above, it is possible to design the center section 2 with more than one blade. For example, a pair of diametrically opposed slots may be formed in the inner hub 14 of the center section, each slot housing a single blade. However, for most applications, a single blade is sufficient to prevent the spool from rotating on the adaptor.

Spool adaptors constructed in accordance with the present invention should be dimensioned in conformity with the various standardized spools used in the industry. Each circular plate 34,38 should extend radially at least to the height of the coiled material 62 wound on the spool but more preferably extends beyond this height to prevent the tie material from unravelling over the edges of the plates. Of course, the diameters of the plates 34,38 ultimately depend on many factors including the type of tie wrapping machine used, the back tension provided to the coil and the angle at which the tie material is payed off the spool.

To accommodate spools on which tie material is not wrapped entirely to the edge of the core 24, thus leaving an edge portion 78 of the core exposed, two recesses 80 are formed, one in the inner surface 82 of the collar 46 of the second flange section 6 and the other in the inner surface 84 of the boss 12 of the center section 2. Each recess 80 extends circumferentially about and borders the inner hubs 14,48. The depth of each recess 80 conforms to the width of the exposed edge portion 78 of the core so that, when the spool is mounted on the adaptor, the side walls 60 of the coil 62 abut the inside surfaces 86,88 of the circular plates 34,38. This is to prevent tie material from slipping into the spaces ordinarily formed between the plates and the coil side walls when a spool having an exposed core edge portion 78 is mounted on an adaptor formed without recesses.

To facilitate insertion of the spool onto the adaptor and, likewise, the adaptor onto the spindle 10 of the tie wrapping machine, the edges of the inner hub 14 and main body portion 16 of the center section 2 and the inside edge of the inner hub portion 48 of the second flange section 6 may be beveled. For safety reasons, it is advisable to bevel all sharp exposed edges, such as those found on the collar 46 and the boss 12.

The spool adaptor according to the present invention is designed to be inexpensively manufactured and readily assembled. It is simple in construction and requires a minimum number of parts but yet is sufficiently versatile to accept many standardized spools used in the industry. It is easily broken down into two main components—the removable second flange section 6 and a center section/first flange section assembly—for compact storage and handling. The spool engaging means simply and effectively holds the spool in position on the adaptor and eliminates the complicated, multi-element spool engaging devices found on prior art adaptors.

Although illustrative embodiments of the invention have been described herein with reference to the accompanying drawings, it is to be understood that the invention is not limited to those precise embodiments, and that various other changes and modifications may be effected therein by one skilled in the art without departing from the scope or spirit of this invention.

What is claimed is:

1. An adaptor for use with a spool of coiled elongated material having a cylindrical center core around which the material is wrapped, the adaptor comprising a cylindrical center section having a bore formed axially at least partially therethrough, first and second flange sections mounted to the ends of the center section, at least one of the flange sections being removable therefrom, and means for engaging a spool mounted on the adaptor to prevent rotational movement of the spool relative to the adaptor, the spool engaging means including a blade mounted on the adaptor and having a sharpened edge which engagingly contacts the center core of the spool to secure the spool in place on the adaptor, the center section including a cylindrical boss situated at an outermost end of the center section, a cylindrical inner hub adjacent the boss which is dimensioned to be closely received by the core of the spool so as to prevent radial movement of the spool on the adaptor and a main body portion extending from the inner hub to the opposite end of the center section.

2. An adaptor for use with a spool of coiled elongated material having a cylindrical center core around which the material is wrapped, the adaptor comprising a cylindrical center section having a bore formed axially at least partially therethrough, first and second flange sections mounted to the ends of the center section, at least one of the flange sections being removable therefrom, and means for engaging a spool mounted on the adaptor to prevent rotational movement of the spool relative to the adaptor, the spool engaging means including a blade mounted on the adaptor and having a sharpened edge which engagingly contacts the center core of the spool to secure the spool in place on the adaptor, the center section including a cylindrical boss situated at an outermost end of the center section, the first flange section including a circular plate having a central opening formed therein for mounting the plate to the boss, the second flange section including a cylindrical mounting hub having a bore formed axially therein to at least partially receive an end of the center section, a circular plate mounted to the mounting hub and means for removably mounting the second flange section to the center section.

3. An adaptor as defined in claim 1 wherein the boss of the center section includes a stepped portion formed in the circumferential surface thereof and the first flange section includes a circular plate having a central opening formed therein to receive the stepped portion of the boss for mounting the first flange section to the center section.

4. An adaptor as defined in claim 4 wherein the first flange section is mounted to the center section by press fitting the circular plate of the first flange section onto the stepped portion of the boss.

5. An adaptor as defined in claim 2 wherein the mounting means of the second flange section includes a thumb-screw which is received by a bore formed in the mounting hub and extending radially from a circumferential surface of the mounting hub to the axial bore formed therein, the thumbscrew advancing into its respective bore when turned so as to contact the center section with a force sufficient to secure the second flange section to the center section.

6. An adaptor as defined in claim 2 wherein the mounting hub of the second flange section includes an outer collar and an inner hub portion adjacent the collar, the outer collar having a stepped portion formed in the circumferential surface thereof and received by the central opening formed in the plate of the second flange section for mounting the plate to the mounting hub, the inner hub portion of the second flange section being dimensioned to be closely received by the core of the spool so as to prevent radial movement of the spool on the adaptor.

7. An adaptor for use with a spool of coiled elongated material having a cylindrical center core around which the material is wrapped, the adaptor comprising a cylindrical center section having a bore formed axially at least partially therethrough, first and second flange sections mounted to the ends of the center section, at least one of the flange sections being removable therefrom, and means for engaging a spool mounted on the adaptor to prevent rotational movement of the spool relative to the adaptor, the spool engaging means including a blade mounted on the adaptor and having a sharpened edge which engagingly contacts the center core of the spool to secure the spool in place on the adaptor, the center section including a cylindrical inner hub situated near an end of the center section, the spool engaging means further including a pair of spacer pads between which the blade is interposed, the spacer pads and blade being at least partially housed by a slot formed in a surface of the inner hub of the center section, the blade being adjustably held in place by at least one set screw which is received by a bore formed in the inner hub, the bore extending from a surface of the hub to the slot.

8. An adaptor as defined in claim 1 wherein the center section has a recess formed in a surface of the boss, the recess extending circumferentially about and bordering the inner hub and having a depth which conforms to the width of an exposed edge portion of the core of the spool.

9. An adaptor as defined in claim 6 wherein the second flange section has a recess formed in a surface of the outer collar, the recess extending circumferentially about and bordering the inner hub portion of the mounting hub and having a depth which conforms to the width of an exposed edge portion of the core of the spool.

10. An adaptor as defined in claim 5 wherein the center section has a groove formed in the circumferential surface thereof which is dimensioned to receive the foot of the thumbscrew.

11. An adaptor as defined in claim 10 wherein the width of the groove formed in main body portion is larger than the diameter of the thumbscrew to allow the second flange section to be adjustably positioned on the center section.

12. An adaptor for use with a spool of coiled elongated material having a cylindrical center core around which the material is wrapped, the adaptor comprising a cylindrical center section having a bore formed axially at least partially therethrough and adapted to coaxially receive a supporting spindle, first and second flange sections mounted to the ends of the center section, at least one of the flange sections being removable therefrom, and means for engaging a spool mounted on the adaptor to prevent rotational movement of the spool relative to the adaptor, the spool engaging means including a blade mounted on the adaptor and having a sharpened edge which engagingly contacts the center core of the spool to secure the spool in place on the adaptor, the center section including at least one set screw which is received by a hole formed radially in the center section, the screw receiving hole extending from the circumferential surface of the center section to the bore formed axially therein so that the set screw can be advanced in the hole to engage the spindle with a force sufficient to secure the adaptor on the spindle and prevent the adaptor from rotating thereon.

13. An adaptor as defined in claim 1 wherein the length of the set screw is less than that of the receiving hole to allow the set screw to be at least flush with the surface of the center section without engaging the spindle.

* * * * *